US009587397B1

(12) United States Patent
McCary, Sr.

(10) Patent No.: US 9,587,397 B1
(45) Date of Patent: Mar. 7, 2017

(54) INSULATING AND SUPPORT ASSEMBLY

(71) Applicant: John Milner McCary, Sr., Birmingham, AL (US)

(72) Inventor: John Milner McCary, Sr., Birmingham, AL (US)

( * ) Notice: Subject to any disclaimer, the term of this patent is extended or adjusted under 35 U.S.C. 154(b) by 0 days.

(21) Appl. No.: 14/756,648

(22) Filed: Sep. 29, 2015

(51) Int. Cl.
*E04B 1/76* (2006.01)
*E04B 1/80* (2006.01)
*E04F 13/04* (2006.01)

(52) U.S. Cl.
CPC ..... *E04B 1/7608* (2013.01); *E04B 1/7654* (2013.01); *E04B 1/7675* (2013.01); *E04B 1/80* (2013.01); *E04F 13/04* (2013.01)

(58) Field of Classification Search
CPC ..... E04B 1/7608; E04B 1/80; E04B 1/7654; E04B 1/7675; E04F 13/0803
See application file for complete search history.

(56) References Cited

U.S. PATENT DOCUMENTS 3,881,292 A * 5/1975 Porter ..... E04B 1/7612 52/276
6,105,327 A * 8/2000 Kroll ..... E04F 13/08 52/36.4
6,119,424 A * 9/2000 Martin ..... E04B 1/7654 52/404.4
6,901,713 B2 * 6/2005 Axsom ..... E04B 1/80 52/309.17
7,017,315 B2 * 3/2006 Corwin ..... E04D 13/1625 52/404.2
8,782,982 B2 * 7/2014 Lewis ..... E04B 1/7654 52/404.3
2004/0163345 A1 * 8/2004 Alderman ..... B32B 5/02 52/404.1
2011/0296781 A1 * 12/2011 McCary ..... E04C 2/292 52/309.2

* cited by examiner

*Primary Examiner* — Andrew J Triggs

(57) ABSTRACT

The invention is a roof, floor and wall rigid foam insulating and supporting manufactured form that is placed on and between a rafter, joist, or on wall stud support members. Raised support ridges on either side of the rigid foam form are placed on the rafter, joist or stud, and has recessed sections that lie between the support ridges. Overlapping sections on the support ridges allow for uneven spaced support members. The rigid foam form has the flexural strength to hold concrete, cementous or other protective composition material applied upon the surface of the rigid foam form. Roof or floor sheathing or covering can be placed upon the ridge line and fastened into the rafter or joist. Alternatively, spacer studs, that give height adjustment and a solid placement surface, can be placed into the support ridge spacer stud slots before sheathing or covering is placed.

12 Claims, 3 Drawing Sheets

INSULATING AND SUPPORT ASSEMBLY

BACKGROUND OF THE INVENTION

In most building structures there is the need to insulate the building from the heat and cold. Insulating the roof, floor or wall system can assist in insulating a building structure. Venting air and moisture from a structure can also assist in temperature control and building structure maintenance.

It can be very effective in a building's cooling and heating to significantly insulate just under the roof, floor or wall sheathing or covering before heat or cold can penetrate into the attic or room area. If insulation of higher R-value can be placed between rafters, joists or studs during the structures construction then time and possible energy costs can be saved.

In Ellis' U.S. Pat. No. 7,818,922, Ellis does show a form of roof insulation placed on roof rafters but Ellis has no allowances for unevenly spaced rafter support members where insulation sheet ribs join the support members. Ellis does not specify his invention to be applied to joists or studs. If the rafters, joists or studs are not evenly spaced or warped Ellis' insulation sheet will not fit over the rafters or support members. Secondly, in Ellis, U.S. Pat. No. 7,818,922, the side of Ellis' insulation sheet does not seal out air flow or moisture around the support members but rather Ellis' rib sides are "inclined" away from the support members. Also, Ellis has no specified means to support a layer of concrete or cementous material. Significantly, Ellis has no specified means to provide additional support, if needed, between the insulation ribs and the support members.

Many parts of a roof or floors system of a structure need a protective poured covering or wear surface. During high wind storms structures can lose shingles along with roof sheathing, metal roofing or other roof covering, allowing moisture to get into the interior of the structure. Structures that are built with very wind resistant walls, such as insulated concrete forms (ICF's), during a high wind storm the walls may stay in tack but the roof is so damaged by the wind that much of the structure's interior is destroyed or lost. Concrete, cementous roof covering can help protect a structure against high winds and storms.

There have been developments in the use of a foam insulation form to assist in the pouring of concrete roofs. Most of the poured concrete roof applications have deal with the pouring of relatively flat concrete decks. In Boeshart's U.S. Pat. No. 6,272,749 and more recently U.S. Pat. No. 6,817,150, entail the use of a rigid foam insulation form and metal channels on the lower section of the form. The rigid foam insulation elongated flat form panel has top slots where when the decking is poured a solid top concrete layer has integrated "T-joists" formed within the slots. The metal channels give support during the concrete pour and can be used to attach ceiling material or other items, such as plumbing or electrical, underneath the insulated concrete decking form.

There have been further form styles implemented similar to that of Boeshart, using rigid foam and metal or wood support to form and pour concrete decking. In some applications the support to the rigid foam concrete decking form is shoring by placing support underneath the decking form, where there may not be any integrated metal channel or wood support within the rigid foam form. Most all of these rigid foam concrete roof/deck form applications have a very heavy flat poured solid top surface being at least two inches or more thick with T-joist slots. Most of the decking forms are not designed to efficiently pour a sloping concrete roof.

None of these protective roof and floor coverings are placed directly on and between the roof rafters or floor joists.

What is needed is a cost effective and easy to install roof and floor, and in some wall systems, highly insulating assembly that can be placed in roof rafters, floor joists or on wall studs of a building. Also what is needed in the assembly is an insulating material with the flexural strength to hold the load of a layer of concrete/cementous material. Additionally what is needed is an insulated concrete roof or floor form that allows roof sheathing or other roof, floor or wall covering to be height adjustable, and a secure placement and attachment to the rafter, joist or stud

SUMMARY OF THE INVENTION

The invention is a rigid foam insulating and supporting manufactured shape or form that is placed on and between a roof rafter, floor joist, and in some application in a wall system, on and between studs. The rigid foam form has raised end sections, support ridges that rest upon the rafters, joists or studs. The rigid foam manufactured form has overlapping sections of the rafter, joist or stud support ridge, the overlaps extending past the center of the upper or middle section of the rafter, joist or stud, which allows the rigid foam form to be able to be placed on rafters, joists or studs that are unevenly spaced or twisted. The rigid foam manufactured form lower side sections has squared sides that run parallel and abut the sides of the rafter, joist or stud. The rigid foam manufactured form is of a significant thickness, approximately 3½ to 9 inches thick in height, with an approximate R-value of approximately R16 to R40. The square side sections attempt to seal out air flow between the squared sides of the rigid foam manufactured form and the sides of the rafter, joist or stud. The center section of the upper surface of the rigid foam manufactured form between the raised rafter, joist or stud support ridge is the recessed upper or middle section. The recessed section is recessed inward from the support ridge at least approximately ⅝ to 1 inch from the height of the support ridge. The recessed section allows air and moisture to be vented out when sheathing or other covering is placed upon the rigid foam form. Also, if placed sheathing or covering has a radiant barrier low emissivity surface adhered on the sheathing's or covering material surface facing the recessed section air space then affective none re-radiation of radiant heat can occur. The rafter, joist or stud support member support ridge of the rigid foam manufactured form has spacer stud slots that spacer studs, approximately 3 to 6 inches in height, approximately 3 to 6 inches in length and approximately 1 to 2 inches in width, can be placed. Roof, floor or wall sheathing or other covering can be placed upon support ridge and fastened into the rafter, joist or stud. Alternatively, spacer studs can be placed into support ridge spacer stud slots before roof, floor or wall sheathing or covering is placed. The spacer studs giving a more solid surface and, if needed, height adjustment for attachment of sheathing or other covering.

A second benefit and important embodiment of the rigid foam manufactured form is that concrete, cementous or other poured protective composition material can be poured upon the upper surface of the rigid foam form. The rigid foam manufactured form has the flexural strength to hold an upper surface load of at least 0.17 psi (pounds per square inch). Another embodiment entails a vertical "T" slot manufactured into the recessed upper section of the rigid foam form to give added support to the roof or floor system when concrete or cementous material is applied to the rigid foam form surface and into the vertical "T" slot. Rebar, wire mesh or other reinforcing can be placed into the poured or applied concrete, cementous or other composition poured protective material. Spacer studs can be placed in spacer stud slots before any concrete, cementous or other poured protective composition material is poured upon the surface of the rigid foam manufactured form. In one embodiment the rafter or joist ridge lines have through openings that allow concrete, cementous or other poured protective composition material to flow through. Roof or floor sheathing can then be placed upon the spacer studs and the sheathing fastened into the rafter or joist.

BRIEF DESCRIPTION OF THE INVENTION

Figure 3:
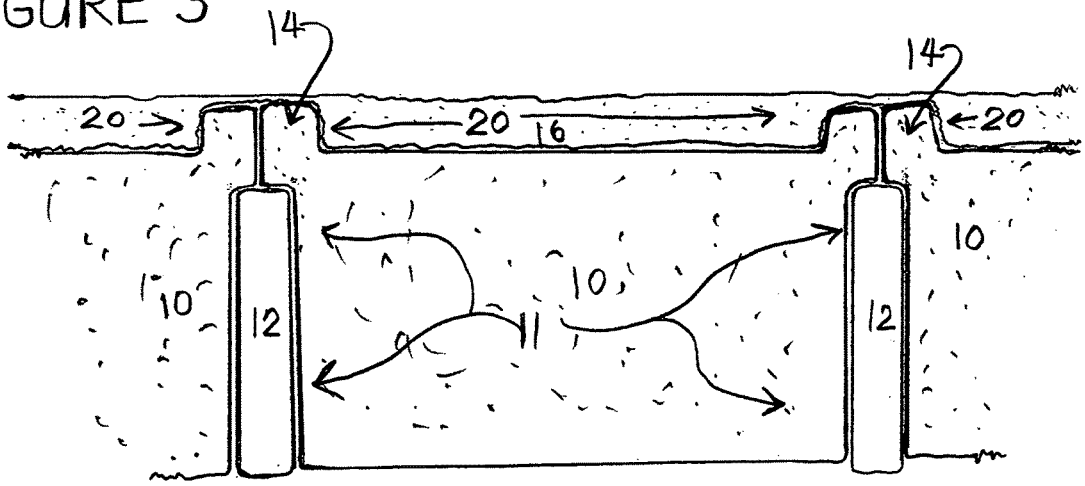

Shown, in a front cross-sectional view in FIG. 3, the roof, floor and wall insulating and support assembly with the rigid foam form placed between roof rafters or floor joists with concrete poured upon the total upper surface.

Figure 4:
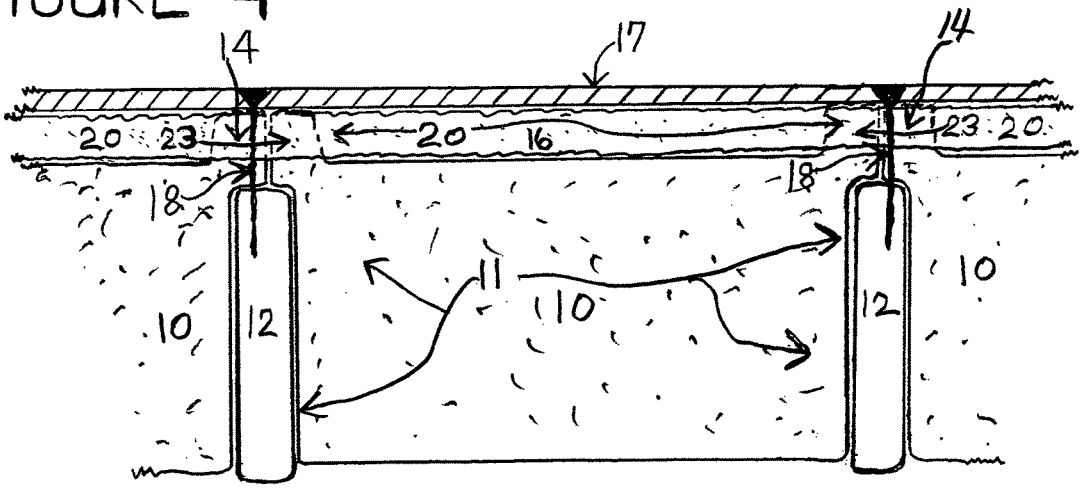

FIG. 4 is a front cross-sectional view the roof, floor and wall insulating and support assembly with the rigid foam manufactured form placed between roof rafters or floor joists with concrete poured upon the recessed area of the upper surface with concrete flowing through an opening in the rafter or joist ridge line and sheathing or covering placed on the rafter or joist support ridge.

Figure 5:
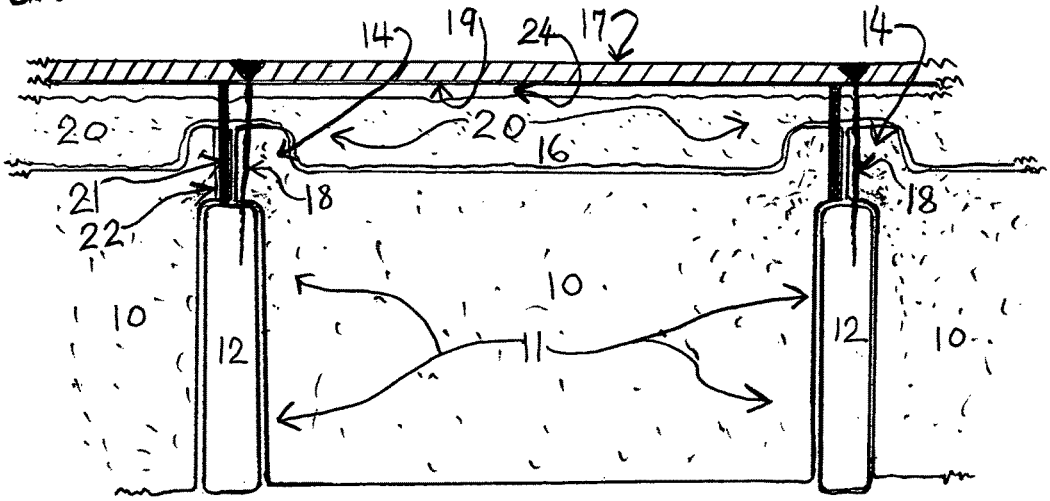

FIG. 5 shows in a front cross-sectional view the roof, floor and wall insulating and support assembly with the rigid foam form placed between roof rafters or floor joists with spacer studs placed in the rafter or joist support ridge spacer slots, concrete or cementous material poured upon the upper surface of the rigid foam, plus sheathing placed upon the spacer studs.

Figure 6:
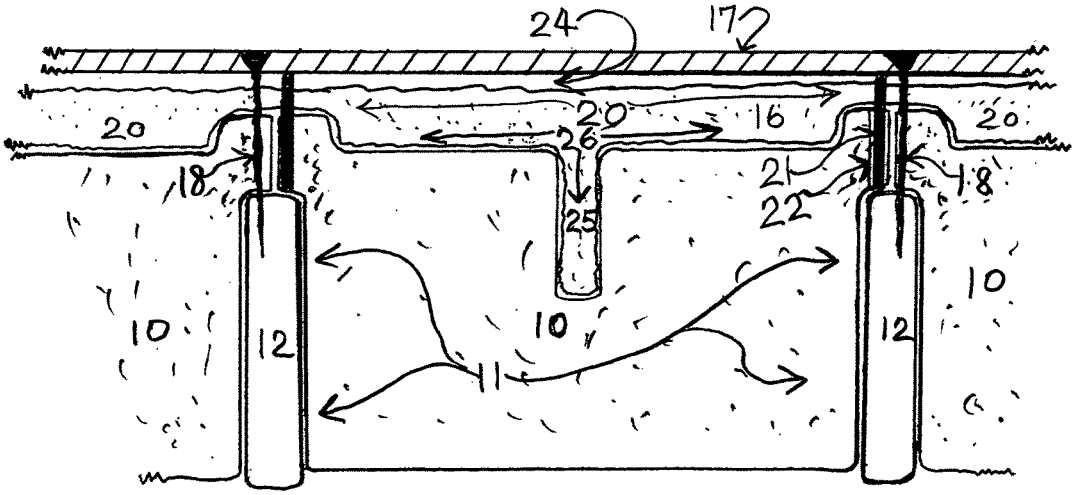

Shown in FIG. 6, in a front cross-sectional view the roof, floor and wall insulating and support assembly with the rigid foam form placed between roof rafters or floor joists with concrete or cementous poured upon the upper surface and poured into a vertical "T" slot.

DETAILED DESCRIPTION OF THE PREFERRED EMBODIMENTS

Figure 1:
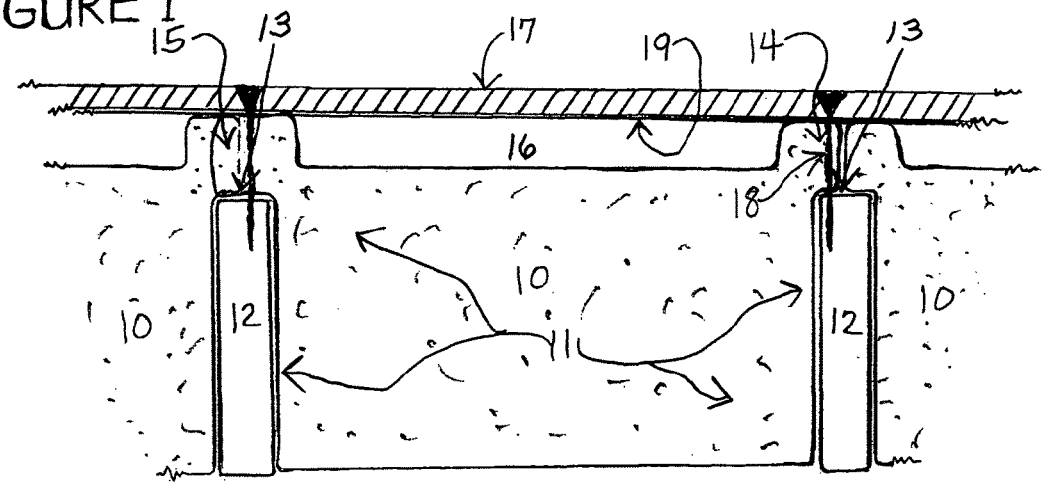
FIG. 1 shows in a front cross-sectional view the roof, floor and wall insulating and support assembly with the rigid foam manufactured form placed between roof rafters, floor joists or wall stud with sheathing or covering placed upon the rafter, joist or stud placed support ridge.

FIG. 1 shows in a front cross-sectional view the roof, floor and wall insulating and support manufactured assembly 10 with the rigid foam manufactured form 11 placed on and between a supporting member, rafter, joist or stud 12. The center section 13 of the supporting members 12 is shown with the raised support ridge 14 placed upon the rafter, joist or stud. An overlap section 15 is shown where a section of the support ridge extends past the center section 13 of the support member 12. The recessed section 16 is shown. Sheathing or other covering 17 is placed upon the support ridge 14 with fasteners 18 attaching the sheathing or covering to the support members 12. A low emissivity radiant barrier 19 is placed on the surface of the sheathing or covering 18 facing the rigid foam form.

Figure 2:
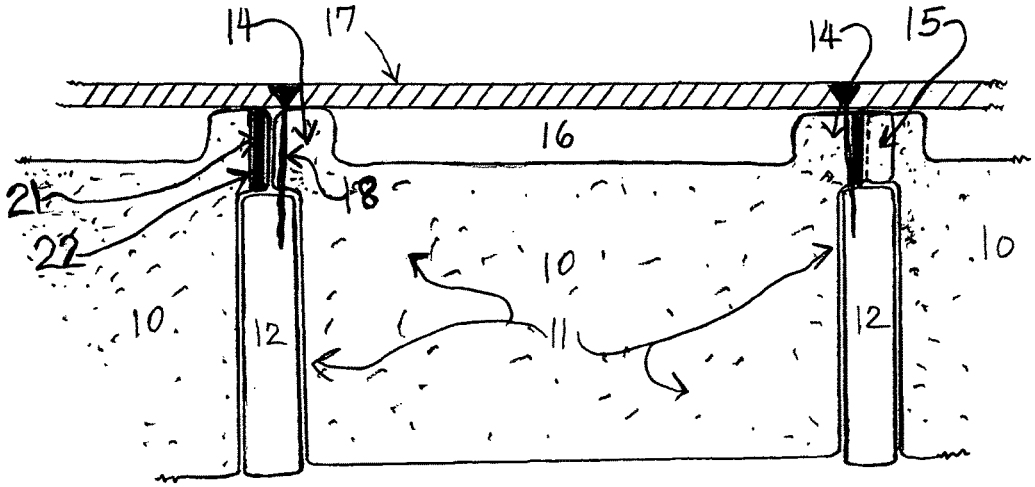
FIG. 2 shows in a front cross-sectional view the roof, floor and wall insulating and support assembly with the rigid foam form placed between roof rafters or floor joists with spacer studs placed in the rafter, joist or stud support ridge.

FIG. 2, in a front cross-sectional view, shows the roof, floor and wall insulating and support manufactured assembly 10 with rigid foam form 11, support members 12, support ridges 14, support ridge overlap 15, recessed section 16. Also shown is the spacer studs 20 placed in spacer stud slots 22. Sheathing or covering 17 is placed on the spacer studs 21 and the support ridges 14. Fasteners 18 attach the sheathing or covering to the support members 12.

FIG. 3 shows in a front cross-sectional view the roof, floor and wall insulating and support manufactured assembly 10, with rigid foam form 11, support members 12, support ridges 14 and recessed section 16. Concrete or cementous material 20 is poured or applied on the surface of the rigid foam from 11. FIG. 4, in a front cross-sectional view the roof, floor and wall insulating and support manufactured assembly 10, with rigid foam form 11, support members 12, support ridges 14 and recessed section 16. Concrete or cementous material 20 is poured or applied to the surface of the rigid foam form 11. Shown are the support ridge flow-throughs 23, open sections in the support ridge 14, allowing the concrete or cementous material to flow through in sections of the support ridge. Sheathing or covering 17 is placed on the support ridge 14, and fasteners 18 attach the sheathing or covering to the support members 12.

Shown in FIG. 5, in a front cross-sectional view, the roof, floor and wall insulating and support manufactured assembly 10, with rigid foam form 11, support members 12, support ridges 14 and recessed section 16. Spacer studs 21 are placed in spacer stud support ridge slots 22. Concrete or cementous material 20 is poured or applied on the surface of the rigid foam from 11. Sheathing or covering 17 is placed on the spacer studs 21 and the support ridges 14. Fasteners 18 attach the sheathing or covering to the support members 12. A low emissivity radiant barrier 19 is placed on the surface of the sheathing or covering 17 facing the rigid foam form with an air and moisture venting space 24 between the low emissivity radiant barrier and the concrete or cementous material.

FIG. 6 shows in a front cross-sectional view, the roof, floor and wall insulating and support manufactured assembly 10, with rigid foam form 11 having a vertical "T" slot 25, support members 12, support ridges 14 and recessed section 16. Spacer studs 21 are placed in spacer stud support ridge slots 22. Concrete or cementitious material 20 is poured or applied on the surface of the rigid foam from 11 and into the vertical "T" slot 25 where the poured or applied concrete or cementitious material 20 forms a support "T" style beam 25 and 26 when hardened dry. Sheathing or covering 17 is placed on the spacer studs 21 and the support ridges 14. Fasteners 18 attach the sheathing or covering 17 to the support members 12. An air and moisture venting space 24 is between the sheathing or covering and the concrete or cementitious material.

The invention claimed is:

1. A roof, floor and wall insulating and support assembly comprising:

a rigid foam manufacturing form placed on and between supporting members such as roof rafters, floor joists or wall studs, the supporting members having sides, a center and spacer stud slots;

wherein the rigid foam manufactured form has a thickness that is approximately 3½ to 9 inches thick in height and has an approximate R-value of R16 to R40;

wherein the rigid foam manufactured form has a flexural strength of at least 0.17 pounds per square inch;

wherein the rigid foam manufactured form has raised end sections or support ridges;

wherein the support ridges are placed on adjacent support members such that a section of the support ridge extends past the center of the support members;

wherein the rigid foam manufactured form has squared sides that run parallel to and abut the sides of the supporting members thereby sealing out air flow between the rigid foam manufactured form and the supporting members, the rigid foam manufactured form also having two surfaces that are primarily perpendicular to the sides of the supporting members;

wherein the support ridges can be elevated to a height above one of the surfaces of the rigid foam manufactured form;

wherein one of the surfaces of the rigid foam manufactured form lying between and adjacent to the support ridges is recessed inward at least approximately ⅝ to 1 inch from the height of the support ridge;

wherein the spacer stud slots space studs approximately 3 to 6 inches in height, approximately 3 to 6 inches in length and approximately 1 to 2 inches in width; and concrete, cementitious or other protective composition material is poured or applied upon the recessed surface of the rigid foam manufactured form.

2. A roof, floor and wall insulating and support assembly according to claim 1, wherein a sheathing or other covering material is placed onto the support ridge to create an open space or air space between a surface of the sheathing or other covering material and one of the recessed surfaces of the rigid foam manufactured form.

3. A roof, floor and wall insulating and support assembly according to claim 2, wherein the sheathing or other covering material can be placed upon one of the support ridges and fastened through the support ridge into the supporting member.

4. A roof, floor and wall insulating and support assembly according to claim 3, wherein the sheathing or other covering material has a radiant barrier low emissivity surface adhered on surface facing the recessed section air space and there is at least an approximate ¾ inch air space between the low emissivity radiant barrier outer surface and the recessed surface of the rigid foam manufactured form surface then affective none re-radiation of radiant heat can occur.

5. A roof, floor and wall insulating and support assembly according to claim 3, wherein spacer studs are placed into the support ridge spacer stud slots before sheathing or covering is placed.

6. A roof, floor and wall insulating and support assembly according to claim 2, wherein the sheathing or other covering material can be placed onto the support ridge and fastened through the support ridge into the supporting member.

7. A roof, floor and wall insulating and support assembly according to claim 6, wherein the sheathing or other covering material has a radiant barrier low emissivity surface adhered on the sheathing's or covering material's surface facing the concrete, cementitious or other protective composition material and there is at least an approximate ¾ inch air space between the low emissivity radiant barrier outer surface and the concrete, cementitious or other protective composition material then affective none re-radiation of radiant heat can occur.

8. A roof, floor and wall insulating and support assembly according to claim 2, wherein spacer studs are placed in spacer stud slots before any concrete, cementitious or other protective composition material is poured or applied upon the upper or outer surface of the rigid foam manufactured form.

9. A roof, floor and wall insulating and support assembly according to claim 8, wherein the sheathing or other covering material can be placed upon the spacer studs and fastened into the supporting member.

10. A roof, floor and wall insulating and support assembly according to claim 9, wherein the sheathing or other covering material has a radiant barrier low emissivity surface adhered on the sheathing's or covering material's surface facing the concrete, cementitious or other protective composition material and there is at least an approximate ¾ inch air space between the low emissivity radiant barrier outer surface and the concrete, cementitious or other protective composition material then affective none re-radiation of radiant heat can occur.

11. A roof, floor and wall insulating and support assembly according to claim 1, wherein there are open sections through the support ridge, or support ridge flow-throughs, that allow concrete, cementitious or other poured protective composition material to flow through or be applied.

12. A roof, floor and wall insulating and support assembly according to claim 1, wherein a vertical slot is formed, approximately 3 to 5 inches in height, near a center of the recessed section of the rigid foam manufactured form such that when the poured or applied concrete, cementitious or other protective composition material dries, in the upper recessed section and the vertical slot, a supporting "T" beam style support is formed.

* * * * *